US005090296A

United States Patent [19]

Todd

[11] Patent Number: 5,090,296

[45] Date of Patent: Feb. 25, 1992

[54] PISTON ASSEMBLY AND METHOD

[75] Inventor: William H. Todd, Winston-Salem, N.C.

[73] Assignee: Todd Motion Controls Inc., Winston-Salem, N.C.

[21] Appl. No.: 639,117

[22] Filed: Jan. 9, 1991

[51] Int. Cl.[5] ..... F15B 13/00

[52] U.S. Cl. ..... 91/518; 91/519; 92/108

[58] Field of Search ..... 91/519, 518, 514, 156, 91/466; 92/107, 108; 60/425

[56] References Cited

U.S. PATENT DOCUMENTS

| | | | |
|---|---|---|---|
| 2,284,228 | 5/1942 | Page | 60/426 |
| 3,168,853 | 2/1965 | Prince | 92/107 |
| 3,511,133 | 5/1970 | Day | 92/108 |
| 3,996,839 | 12/1976 | Norwood | 92/108 |
| 4,300,584 | 11/1981 | Kosarzecki | 91/355 |
| 4,750,408 | 6/1988 | Stoll | 92/107 |
| 4,976,187 | 12/1990 | Yeazel | 91/173 |

FOREIGN PATENT DOCUMENTS

| | | | |
|---|---|---|---|
| 2465110 | 4/1981 | France | 92/108 |
| 0113611 | 7/1983 | Japan | 92/108 |

*Primary Examiner*—Edward K. Lock
*Assistant Examiner*—Hoang Nguyen

[57] ABSTRACT

A piston assembly employs a central velocity tube which provides an increase in speed of the initial downward stroke phase while requiring less power than conventional hydraulic cylinder assemblies. A second stage hydraulic surge causes the piston to forcefully descend the final increment of the downstroke for an increase in power of the piston. The return or upstroke of the piston is of conventional hydraulic design.

10 Claims, 2 Drawing Sheets

PISTON ASSEMBLY AND METHOD

BACKGROUND OF THE INVENTION

1. Field of the Invention

This invention relates to improved piston assemblies for various uses and for replacement of conventional hydraulic cylinders, one embodiment having a central velocity tube which passes through the piston head for providing hydraulic thrust to the inside of the piston rod during the downstroke.

2. Description of the Prior Art and Objects of the Invention

Various piston assemblies including pneumatic and hydraulic types have been utilized in the past for a variety of purposes including baling, compacting and pressing and other industrial uses. Compacting devices utilizing hydraulic cylinders have been conceived and operated for many years and these devices generally have a single conventional work force piston which can be either pneumatically or hydraulically operated depending upon the quantity of force required as generated by the cylinders. The pistons within the cylinders are sized according to the power sources utilized such as pumps for various hydraulic fluids or pressurized air sources for pneumatic or gas operated cylinders.

Hydraulic device such as presses are well known in the industry and are operated in accordance with Pascal's Principle that: a large force exerted through a short distance is obtained by exerting a small force through a relatively long distance.

In certain standard hydraulic presses, only one work piston is utilized and a single fluid is generally used to power the apparatus and drive the work piston. In certain applications it would be more economically beneficial to have a work piston driven by pneumatic means under certain conditions and under other conditions, to drive the work piston by hydraulic means. It would be more economically feasible to power a piston under relatively low power or pressure until the work load is reached, and upon contact with the work load, a higher power or pressure provided to actually perform the work such as stamping, compacting or the like. In addition it would be advantageous to move the piston at a greater velocity under a no load condition, and upon reaching the work load the piston could then decrease its speed while increasing it power.

However, conventional hydraulic and pneumatic cylinders generally utilize a single pump or power source to drive the piston under a single, constant power or pressure and much energy is wasted by the cylinder prior to the work being reached by the relatively slow piston speed.

Therefore, with the shortcomings and disadvantages known to prior art hydraulic and pneumatic piston assemblies the present invention was conceived and one of its objectives is to provide a piston assembly having dual power and method of operation which is more economical and efficient to operate than conventional piston assemblies.

It is another objective of the present invention to provide a piston assembly and method whereby a piston assembly can be operated utilizing one or more means such as pneumatic or hydraulic to drive the piston.

It is another objective for this invention to provide a piston assembly which can be used to retrofit existing pneumatic and hydraulic equipment, which will use a smaller, more economical power supply.

It is yet another objective of the present invention to provide a method of operating a piston assembly whereby fluid under relatively low pressure is directed into the piston assembly housing to rapidly move a piston head to the work load and whereafter means are then employed to supply a relatively high pressure or force to further drive the piston to create the force necessary for the particular work load.

It is likewise an objective of the invention to provide an embodiment of the piston assembly having a hollow piston rod which is in fluid communication with a central velocity tube which passes through the piston head whereby, when fluid is pumped into the hollow piston rod causing the piston to advance, fluid is drawn into the piston well by means of atmospheric pressure filling the void created by the vacuum force.

Still another objective of the invention is to provide a piston assembly which will operate with increased cycle speeds due to a two stage fluid input.

Various other objectives and advantages of the present invention will become apparent to those more skilled in the art as a more detailed description of the invention is presented below.

BRIEF SUMMARY OF THE INVENTION

In one embodiment of the invention, a piston assembly is provided with a single piston head and includes a central velocity tube which passes through the piston head, into communication with a hollow piston rod. In a two stage power stroke, fluid under pressure first travels through the velocity tube to the distal end of the piston rod, causing the piston to rapidly move towards the bottom of its stroke. Due to the small diameter of the velocity tube, and consequently the high pressure developed, the piston advances at a much higher rate of speed during its initial "downward" stroke while utilizing a smaller capacity fluid pump having a lower horsepower rating than conventional hydraulic cylinders would require under the same conditions. The piston well prefills under these conditions, i.e., vacuum pressure (14.7 lbs./sq. in.) at sea level. Once the load is met at the conclusion of the initial downward movement, additional hydraulic pressure is then provided in the cylinder above the piston head as a second power stage, to increase the force or power of the piston stroke during its final descent. The piston is then returned during its upstroke to begin the cycle anew by utilizing conventional piston cylinder ports, methods and hydraulic means.

DESCRIPTION OF THE PREFERRED EMBODIMENT OF THE INVENTION

Figure 1:
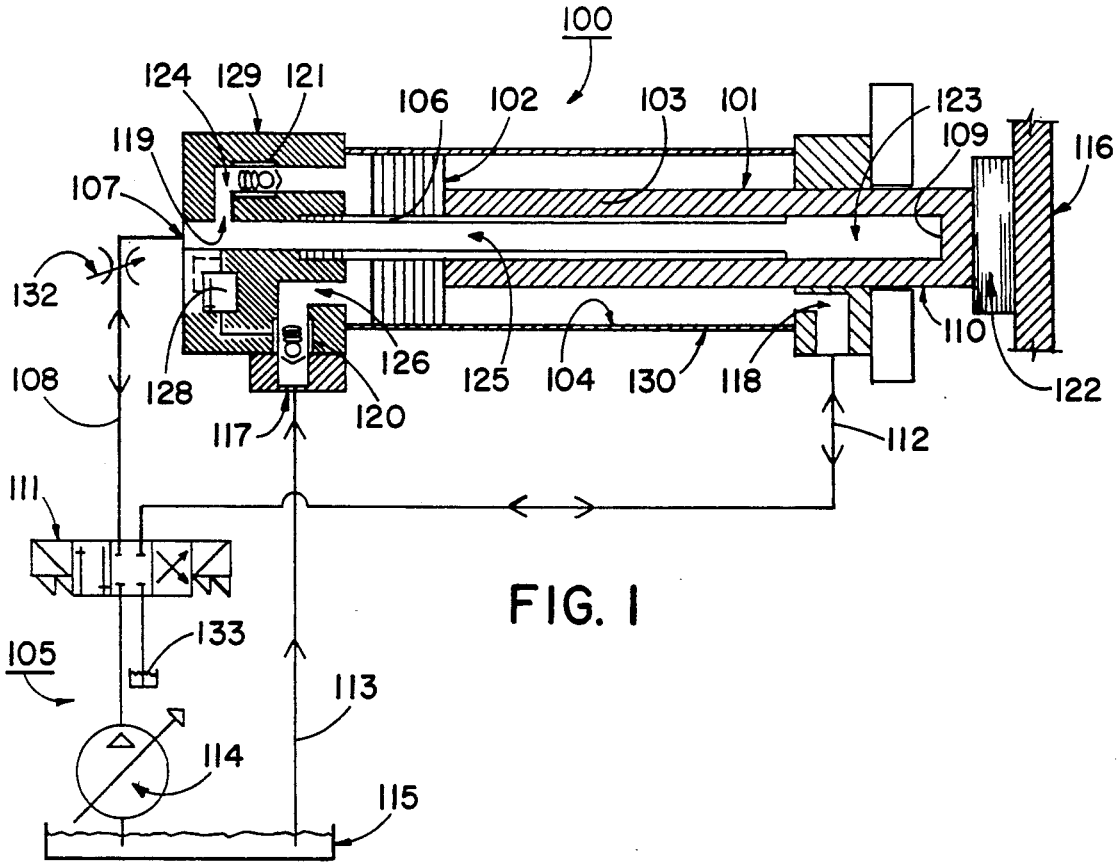
FIG. 1 illustrates one embodiment of a piston assembly having a velocity tube positioned through the piston head for fluid communication with the interior of the hollow piston rod.
Figure 2:
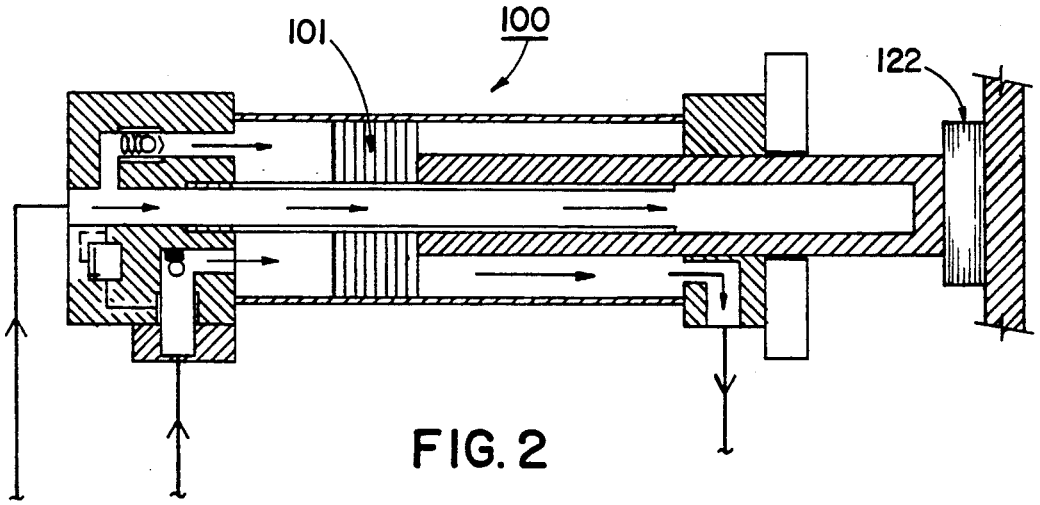
FIG. 2 depicts the piston assembly as seen in FIG. 1 in an extended posture in contact with a work load.
Figure 3:
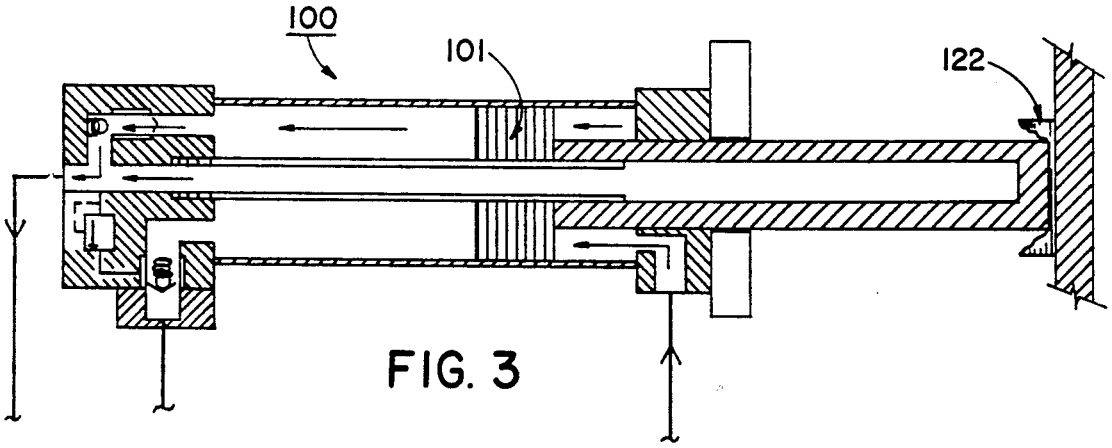
FIG. 3 demonstrates the piston assembly of FIG. 2 as the piston returns to its position as seen in FIG. 1.

The preferred form of the apparatus and method of operation thereof is seen in FIGS. 1-3. As shown therein, a piston assembly comprising a piston cylinder includes a velocity tube which extends through the piston head. Hydraulic controls are connected to the cylinder and to hydraulic lines for operating purposes. In use, fluid under pressure is directed into the velocity tube which communicates with the hollow piston rod conduit, forcing the piston along its downward stroke while prefilling the piston well with fluid. Once the work load is met, additional power is supplied to the piston as fluid is pumped into the cylinder above the piston head to apply additional hydraulic pressure for the force necessary for the work load encountered. These dual power stages cause the piston assembly to function efficiently since only a small amount of power or force is required to drive the piston during its initial stage, to bring it into contact with the work load. Thereafter, the second stage or hydraulic force provides the additional power needed to perform the work on the particular load. Once this down cycle is complete, the controls which consist of conventional electrically operated hydraulic solenoid valves or the like direct fluid into the cylinder below piston head, forcing the piston upwardly to the top of its stroke, while check valves allow the fluid previously furnished above the piston head to exit from within the cylinder walls.

DETAILED DESCRIPTION OF THE DRAWINGS AND OPERATION OF THE INVENTION

In the piston assembly embodiment as seen in FIG. 1, piston assembly 100 comprises piston 101 having piston head 102 joined to piston rod 103 contained within inner cylinder wall 104 of piston cylinder 130. Fluid velocity tube 106 passes through piston head 102 and communicates with first fluid channel 107 in cylinder head 129 and piston rod conduit 123. As further shown, fluid flow control means 105 consists of solenoid valve assembly 111, shown in schematic fashion with fluid pump 114 which is joined to piston assembly 100 through first fluid pipe 108, second fluid pipe 112 and third fluid pipe 113. The necessary controls, switches, etc. are conventional and are only shown in schematic fashion as would be understood by those skilled in the art are not intended as complete fluid or electrical drawings. Also, hydraulic or pneumatic systems are often interchanged depending on the particular result required or equipment available to the particular user.

In operation, piston assembly 100 (FIG. 1) begins its cycle as solenoid valve assembly 111 is activated whereby pump 114 forces fluid through first fluid pipe 108 into first fluid channel 107. The directed fluid which may be hydraulic oil or the like is then forced through velocity tube 106 and into piston rod conduit 123 where the oil contacts rear piston wall 109, thereby urging piston 101 downwardly (left to right as shown in FIG. 1) where piston rod distal end 110 contacts work load 122 which may be any of a variety of work loads, machinery or the like. Rod stop 116 is shown in FIG. 1 which terminates the downward movement of piston rod 103. Fluid passing through velocity tube 106 rapidly drives piston 101 towards the bottom of its stroke due in part to its relatively small diameter as fluid channel 117 fills from reservoir 115. Once piston rod 103 contacts work load 122, sequence valve 128 is activated to provide fluid pressure in channel 117 of piston head 129 to make available additional power or force to piston 101 and to work load 122 during the final increment of the downward stroke. Needle valve 132 will allow for adjustable speed control during the upstroke and downstroke. Thus, "dual" power is available during the final stages of the downstroke for efficiency in operation. Once the downward stroke is complete, solenoid valve assembly 111 activates to force fluid through second fluid pipe 112 and into fluid channel 118. Fluid passing through channel 118 (right to left in FIG. 1) forces piston head 102 upwardly (right to left in FIG. 1) towards cylinder head 129 for its return stroke. Fluid contained within cylinder walls 104 above (to the left in FIG. 1) piston head 102, during the upward or return stroke portion of the cycle, is forced through fluid conduit 124, past check valve 121, through first fluid pipe 108 and into small reservoir 133.

In FIG. 2, piston 101 is shown in its downward stroke in contact with work load 122 with the arrows depicting the fluid flow direction. In FIG. 3, piston 101 is shown during its return cycle after crushing load 122 which may be a recylcable aluminum beverage container or the like. The arrow in FIG. 3 also illustrates the direction of the fluid flow.

Figure 4:
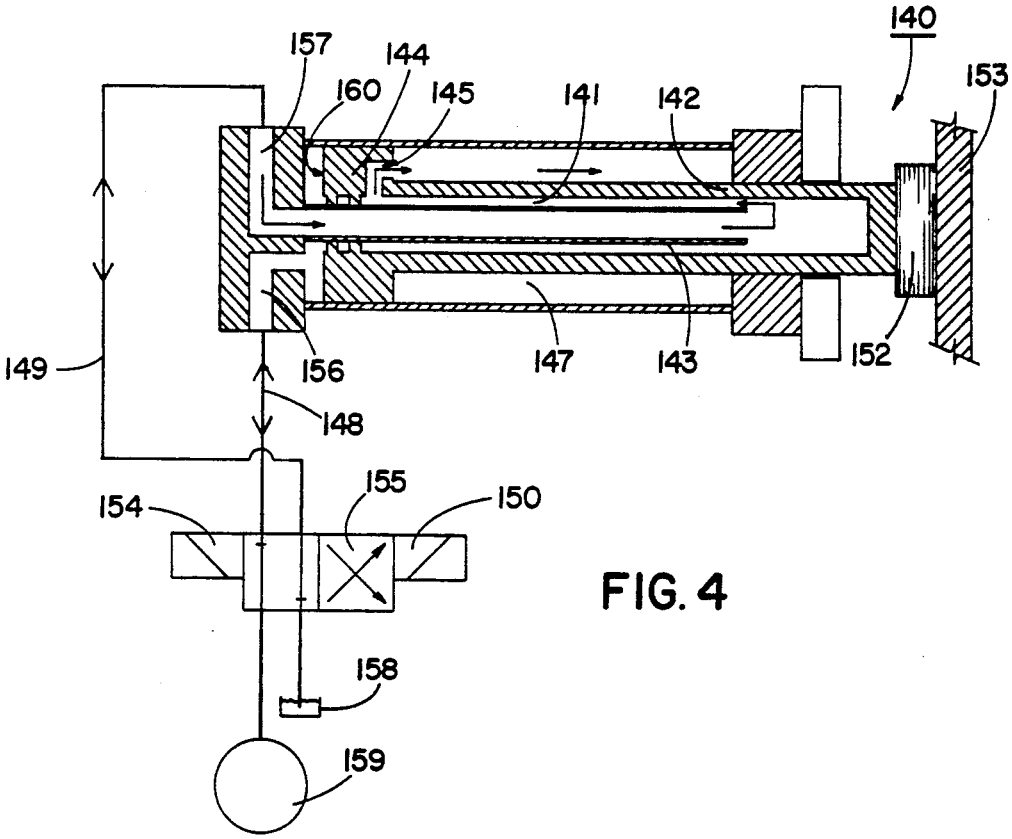
FIG. 4 pictures yet another embodiment of the piston assembly invention with a radial fluid channel in the piston head.

FIG. 4 pictures another piston assembly 140 which includes a fluid velocity tube 143 which passes through piston head 144 and is in fluid communication with first cylinder head chamber 157. Solenoid valve assembly 150 is connected to fluid pump 159 and fluid reservoir 158. In operation, first conduit solenoid 154 as schematically shown is engerized whereby pump 159 forces fluid along first fluid conduit 148 into second cylinder head channel 156 to urge piston 160, consisting of piston head 144 and attached piston rod 142, downwardly or from left to right as shown in FIG. 4. Piston rod 142 then acts on load 152 which is positioned against piston rod stop 153. Once piston rod 142 has fully extended or extended to the degree required for the particular work needed, second conduit solenoid 155 is activated which allows fluid from pump 159 to pass through second fluid conduit 149 into first cylinder head channel 157. The pressurized or forced fluid then flows through fluid velocity tube 143 into fluid relief channel 141, and on into piston head radial channel 145 where it exits into piston well 147. As pressure develops in piston well 147, piston 160 is then forced back, from right to left as shown in FIG. 4 away from load 152, where the cycle can begin anew.

By using the piston assemblies shown above in new or existing machinery, smaller hydraulic pumps can be used with less oil required and smaller air compressors will be needed when using pneumatics. This will result in more economical systems and operations for the ultimate consumers.

The illustrations and examples provided are for explanatory purposes and are not intended to limit the scope of the appended claims as various controls, fluids and other components can be modified by skilled artisans which may, for example utilize conventional gases in place of the hydraulic oils as described herein.

I claim:

1. A piston assembly comprising: a piston housing, said housing defining a piston well, a piston, said piston slidably positioned within said well, said piston comprising a piston head and a piston rod joined thereto, said piston rod comprising a fluid conduit, said piston head defining an opening therein, a fluid tube, said tube positioned within said piston head opening for fluid communication with said rod fluid conduit, a first fluid entry conduit, said first fluid entry conduit in fluid communication with said fluid tube, said first entry conduit for directing fluid therealong to initially urge said piston outwradly, a second fluid entry conduit said second fluid entry conduit in communication with said piston well, said second fluid entry conduit for directing fluid to secondarily urge said piston outwardly, a sequence valve, said sequence valve joined to said second fluid entry conduit, whereby fluid passing through said fluid tube will enter said rod fluid conduit to drive said piston to a workload wherein said sequence valve will then direct fluids into said piston well through said second fluid entry conduit to provide additional force to said piston at said workload.

2. A piston assembly as claimed in claim 1 and including means to supply fluid, said fluid supply means communicating with said fluid tube.

3. A piston assembly as claimed in claim 1 and including a first fluid exit conduit, said first exit conduit communicating with said fluid tube.

4. A piston assembly as claimed in claim 1 and including a first exit check valve, said first exit check valve positioned within said first exit conduit.

5. A piston assembly as claimed in claim 1 and including a second fluid entry check valve, said second check valve positioned within said second fluid entry conduit.

6. A piston assembly as claimed in claim 1 and including a third fluid entry conduit, said third fluid entry conduit communicating with said piston well.

7. A piston assembly as claimed in claim 1 and including means to control fluid flow, said fluid flow control means communicating with said first fluid entry conduit.

8. A piston assembly as claimed in claim 2 and including a solenoid valve, said solenoid valve joined to said fluid supply means.

9. A piston assembly as claimed in claim 2 and including a fluid reservoir, said reservoir connected to said fluid supply means.

10. A piston assembly as claimed in claim 1 including a fluid relief channel said channel positioned between said piston rod and said fluid tube, said relief channel in fluid communication with said rod fluid conduit, a radical channel, said radial channel communicating with said fluid relief channel and said piston well whereby pressurized fluid passing through said relief channel into said piston well will urge said piston to the top of said piston well.

* * * * *